US012753550B2

(12) United States Patent
Hasebe et al.

(10) Patent No.: US 12,753,550 B2
(45) Date of Patent: Oct. 6, 2026

(54) FIBROUS BODY PROCESSING APPARATUS

(71) Applicant: SEIKO EPSON CORPORATION, Tokyo (JP)

(72) Inventors: Karen Hasebe, Shiojiri (JP); Makoto Sato, Matsumoto (JP); Koji Motohashi, Matsumoto (JP); Jun Sakurada, Shiojiri (JP); Toshihiko Yamazaki, Shiojiri (JP); Takashi Abe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 332 days.

(21) Appl. No.: 18/474,297

(22) Filed: Sep. 26, 2023

(65) Prior Publication Data

US 2024/0102239 A1 Mar. 28, 2024

(30) Foreign Application Priority Data

Sep. 28, 2022 (JP) ..... 2022-155087

(51) Int. Cl.
*D21H 11/14* (2006.01)
*D21C 1/02* (2006.01)

(52) U.S. Cl.
CPC ..... *D21C 1/02* (2013.01); *D21H 11/14* (2013.01)

(58) Field of Classification Search
CPC ..... D21C 1/02; D21H 11/14
USPC ..... 162/4
See application file for complete search history.

(56) References Cited

U.S. PATENT DOCUMENTS

2014/0290886 A1* 10/2014 Nagai ..... D21F 9/02 162/252
2018/0251926 A1* 9/2018 Higuchi ..... D04H 1/732
2021/0206019 A1* 7/2021 Miyazawa ..... B27N 3/04

FOREIGN PATENT DOCUMENTS

JP H11-276916 A 10/1999
JP 2012-007246 A 1/2012
JP 2014-177018 A 9/2014
JP 2018-122537 A 8/2018
JP 2021-123837 A 8/2021

* cited by examiner

*Primary Examiner* — Jacob T Minskey
(74) *Attorney, Agent, or Firm* — Spencer Fane LLP

(57) ABSTRACT

A fibrous body processing apparatus includes a humidifying unit, a first processing unit, a second processing unit, a first supply passage, a second supply passage, and a returning passage. The humidifying unit generates humidified air. The first processing unit processes a material that contains fibers. The second processing unit processes the material that was processed at the first processing unit. Humidified air is supplied from the humidifying unit to the first processing unit through the first supply passage. Humidified air is supplied from the first processing unit to the second processing unit, together with the material, through the second supply passage. The returning passage includes an upstream-side end portion and a downstream-side end portion. Humidified air is returned from the second supply passage or the second processing unit to the humidifying unit through the returning passage.

12 Claims, 5 Drawing Sheets

FIBROUS BODY PROCESSING APPARATUS

The present application is based on, and claims priority from JP Application Serial Number 2022-155087, filed Sep. 28, 2022, the disclosure of which is hereby incorporated by reference herein in its entirety.

BACKGROUND

1. Technical Field

Embodiments of the present disclosure relate to a fibrous body processing apparatus.

2. Related Art

A sheet manufacturing apparatus according to related art includes a coarse crusher that coarsely crushes wastepaper, a coarsely-crushed-pieces reservoir portion that temporarily contains coarsely crushed pieces obtained at the coarse crusher, a fixed amount supplying portion that measures the weight of the coarsely crushed pieces and supplies a fixed amount of the coarsely crushed pieces, a defibrating unit that defibrates the coarsely crushed pieces supplied thereto, a deposition unit on which a defibrated material obtained at the defibrating unit accumulates in a planar manner, a heating-and-pressing unit that applies heat and pressure to a web formed by the accumulation, a cutting unit that cuts a sheet obtained at the heating-and-pressing unit into a predetermined sheet shape, and a sheet collection unit that collects the obtained sheet.

In a sheet manufacturing apparatus disclosed in JP-A-11-276916, humidifying units are provided at a plurality of positions for the purpose of enhancing the quality of sheets to be obtained, and humidification is performed on a material such as coarsely crushed pieces, a defibrated material, a web, and the like as the processing of the material proceeds. When humidification is performed on, for example, coarsely crushed pieces among them, humidified air generated at the humidifying unit passes through the coarsely-crushed-pieces reservoir portion and, next, through the fixed amount supplying portion provided downstream thereof, and is then supplied to the defibrating unit.

However, in the sheet manufacturing apparatus disclosed in JP-A-11-276916, stopping the operation of the defibrating unit makes it difficult to supply humidified air to the coarsely-crushed-pieces reservoir portion and the like that are located upstream of the defibrating unit, even if the operation of the humidifying unit is continued. The same holds true for other positions where the humidifying units are provided in the sheet manufacturing apparatus.

SUMMARY

A fibrous body processing apparatus according to a certain aspect of the present disclosure includes a humidifying unit, a first processing unit, a second processing unit, a first supply passage, a second supply passage, and a returning passage. The humidifying unit generates humidified air. The first processing unit processes a material that contains fibers. The second processing unit processes the material that was processed at the first processing unit. Humidified air is supplied from the humidifying unit to the first processing unit through the first supply passage. Humidified air is supplied from the first processing unit to the second processing unit, together with the material, through the second supply passage. The returning passage includes an upstream-side end portion and a downstream-side end portion. Humidified air is returned from the second supply passage or the second processing unit to the humidifying unit through the returning passage.

DESCRIPTION OF EMBODIMENTS

Based on some non-limiting preferred embodiments illustrated in the accompanying drawings, a fibrous body processing apparatus according to the present disclosure will now be explained in detail.

First Embodiment

Figure 1:
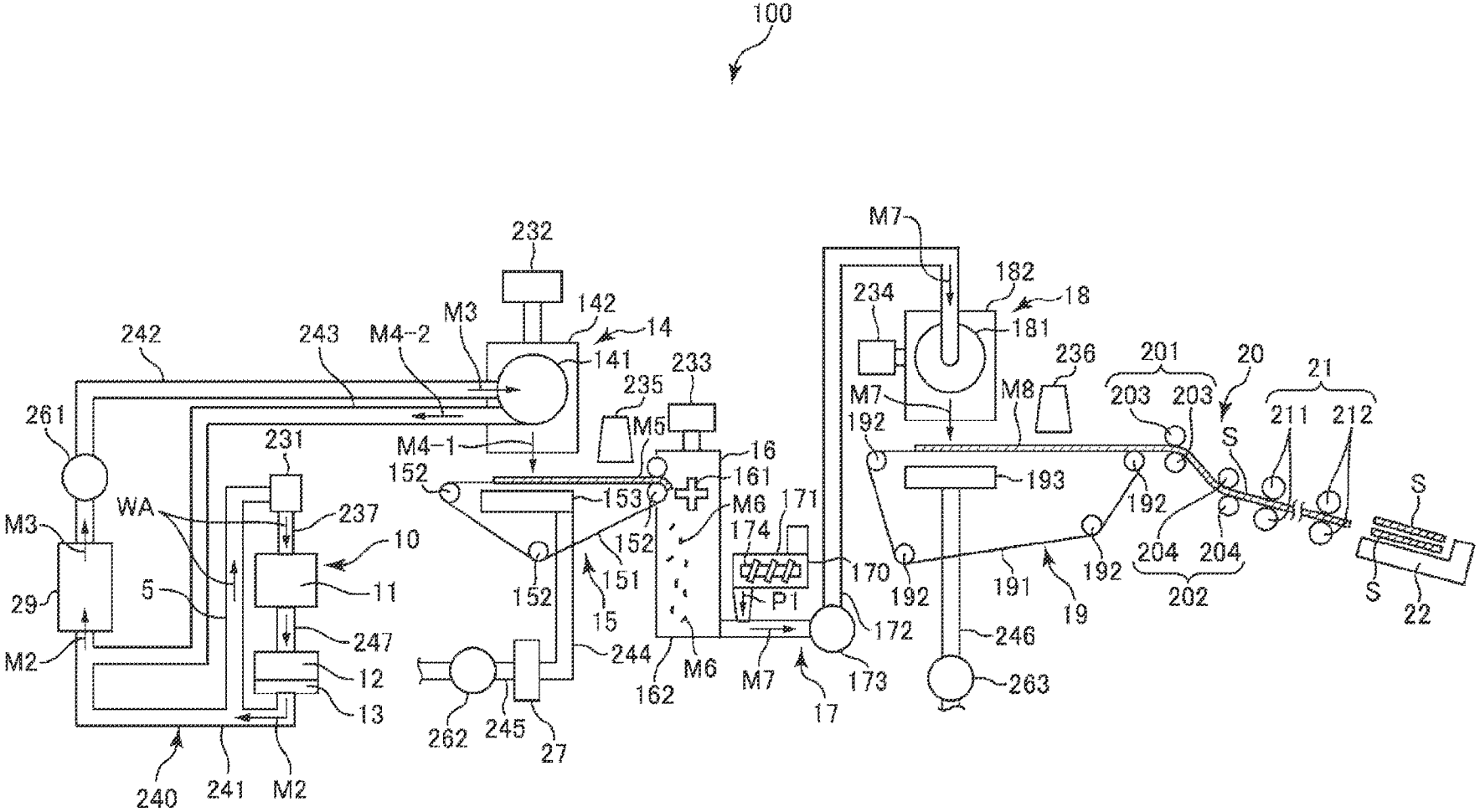
FIG. 1 is a diagram that schematically illustrates the structure of a fibrous body processing apparatus according to a first embodiment of the present disclosure.
Figure 2:
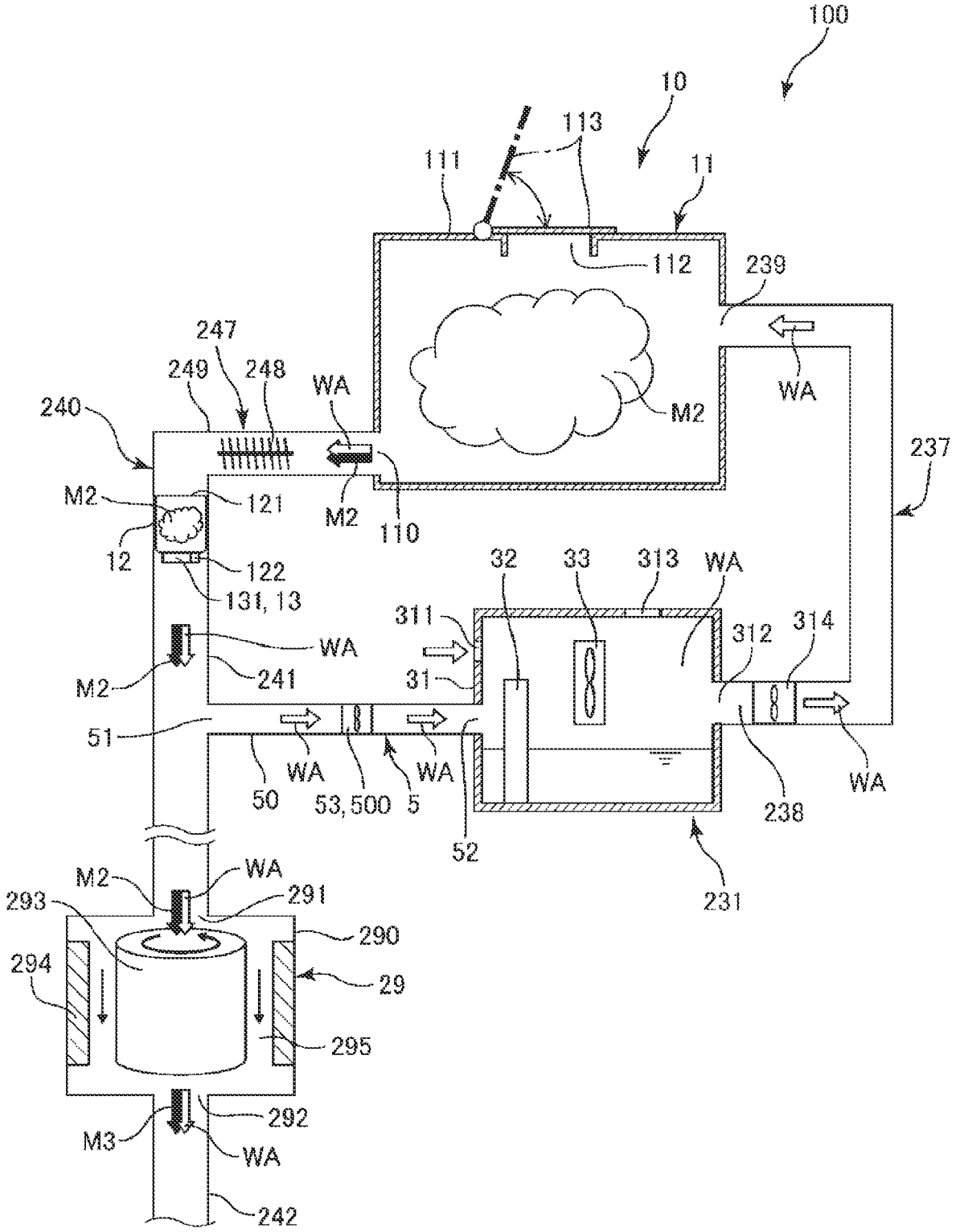
FIG. 2 is a diagram that schematically illustrates the structure of a coarsely-crushed-pieces supplying unit illustrated in FIG. 1, and the neighborhood thereof.
Figure 3:
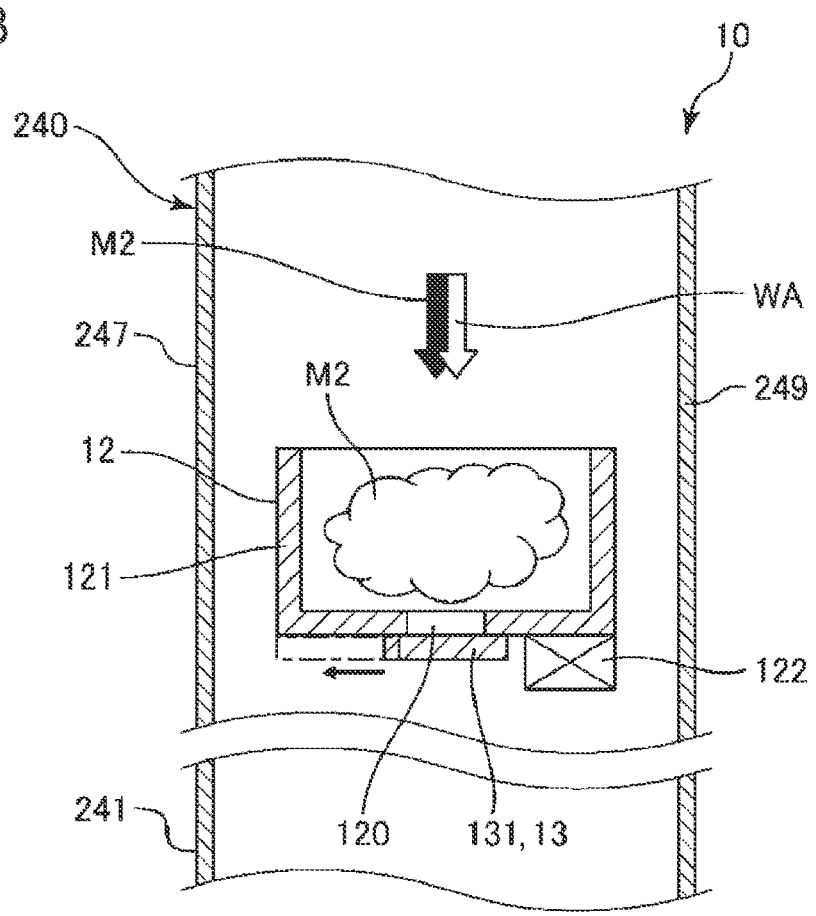
FIG. 3 is an enlarged view of a weight measurement portion and a fixed amount supplying portion illustrated in FIG. 2.
Figure 4:
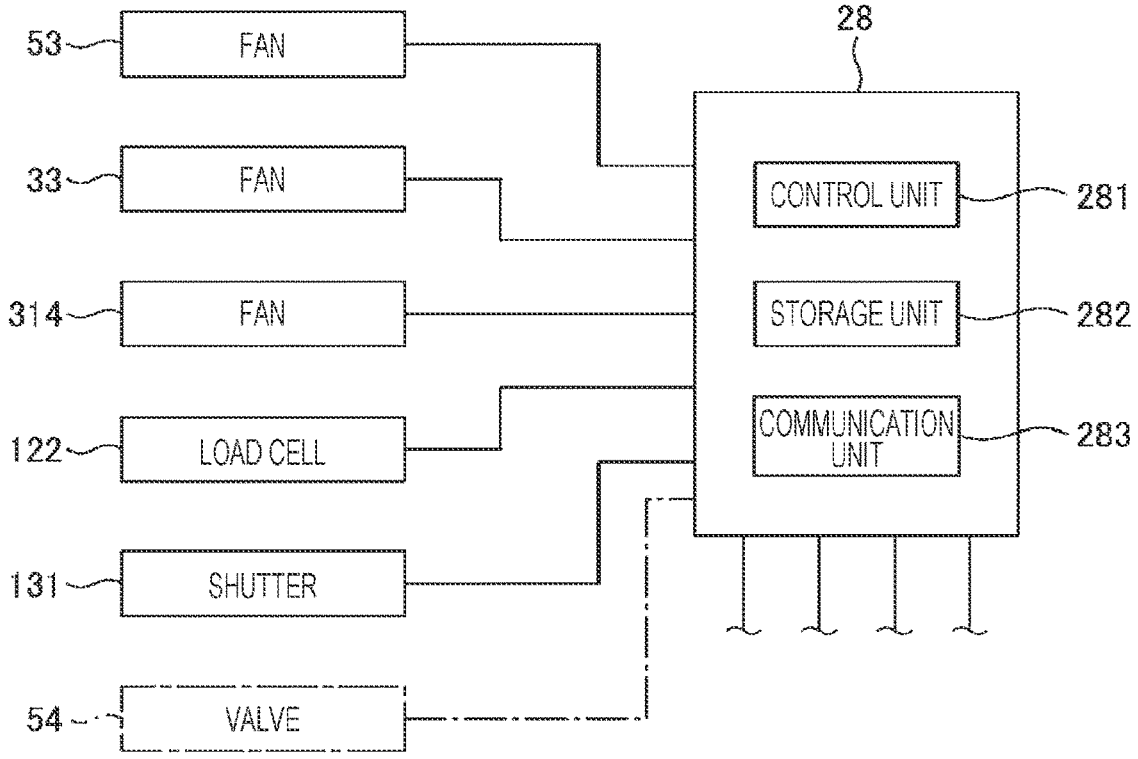
FIG. 4 is a block diagram of the fibrous body processing apparatus according to the first embodiment and a third embodiment.

FIG. 1 is a diagram that schematically illustrates the structure of a fibrous body processing apparatus according to a first embodiment of the present disclosure. FIG. 2 is a diagram that schematically illustrates the structure of a coarsely-crushed-pieces supplying unit illustrated in FIG. 1, and the neighborhood thereof. FIG. 3 is an enlarged view of a weight measurement portion and a fixed amount supplying portion illustrated in FIG. 2. FIG. 4 is a block diagram of the fibrous body processing apparatus illustrated in FIG. 1.

In the description below, an upper position in FIG. 1 may be referred to as "above/over" or "upper", and a lower position therein may be referred to as "below/under" or "lower". Since FIG. 1 is a schematic structure diagram, positional relationships between components of a fibrous body processing apparatus 100, orientations thereof, sizes thereof, and the like are not limited to the illustrated example. The direction in which coarsely crushed pieces M2, a defibrated material M3, a first screened material M4-1, a second screened material M4-2, a first web M5, fragments M6, a mixture M7, a second web M8, and recycled paper S are sent, that is, the direction indicated by arrows in FIG. 1, will be referred to also as "transportation direction". The side indicated by the head of the arrows in FIG. 1 will be referred to also as "downstream side" in the transportation direction, and the side indicated by the tail of the arrows in FIG. 1 will be referred to also as "upstream side" in the transportation direction. The same holds true for humidified air WA and coarsely crushed pieces M2 in FIGS. 2, 3, 5, and 6.

The fibrous body processing apparatus 100 illustrated in FIG. 1 produces sheet-shaped recycle paper from coarsely crushed pieces M2 obtained by, for example, shredding wastepaper such as used copy paper. The generation output of the fibrous body processing apparatus 100 is not limited to the recycled paper S; for example, it may be a molded body having a shape like a block.

As illustrated in FIG. 1, the fibrous body processing apparatus 100 includes a coarsely-crushed-pieces supplying unit 10, a defibrating unit 29, a screening unit 14, a first web forming unit 15, a fragmenting unit 16, a mixing unit 17, a dispersing unit 18, a second web forming unit 19, a shape forming unit 20, a cutting unit 21, a stock unit 22, and a collection unit 27.

The fibrous body processing apparatus 100 further includes a humidifying unit 231, a humidifying unit 232, a humidifying unit 233, a humidifying unit 234, a humidifying unit 235, and a humidifying unit 236. In addition to those described above, the fibrous body processing apparatus 100 includes a blower 261, a blower 262, and a blower 263.

In the fibrous body processing apparatus 100, a coarsely-crushed-pieces supplying process, a defibrating process, a screening process, a first web forming process, a fragmenting process, a mixing process, a disentangling process, a second web forming process, a sheet forming process, and a cutting process are performed in this order.

The structure of each unit will now be explained.

The coarsely-crushed-pieces supplying unit 10 is a section that performs a coarsely-crushed-pieces supplying process of supplying the coarsely crushed pieces M2 to the defibrating unit 29, and includes a coarsely-crushed-pieces reservoir portion 11, a transportation portion 240, a weight measurement portion 12, and a fixed amount supplying portion 13. The structure of each portion of the coarsely-crushed-pieces supplying unit 10 will be described in detail later. The coarsely crushed pieces M2 are obtained by, for example, coarsely shredding a sheet-like material made of a fiber-containing body containing cellulose fibers. The cellulose fibers may be any fibrous material containing cellulose in the context of a chemical compound (cellulose in a narrow sense) as a chief constituent, and may contain hemicellulose or lignin in addition to cellulose (cellulose in a narrow sense).

It is preferable if the coarsely crushed piece M2 has a shape and a size suited for defibration processing performed at the defibrating unit 29. Examples of the shape of the coarsely crushed piece M2 include a square or a rectangle, in particular, a strip shape, in a plan view. With regard to the size of the coarsely crushed piece M2, it is preferable if the small pieces have an average length of one side of 100 mm or less, or more preferably, 3 mm or more and 70 mm or less. The shape of the small piece may be a shape other than a square or a rectangle. It is preferable if the small piece has a thickness of 0.07 mm or more and 0.1 mm or less.

As illustrated in FIG. 2, the humidifying unit 231 is connected to the coarsely-crushed-pieces reservoir portion 11 of the coarsely-crushed-pieces supplying unit 10 via a humidified air sending portion 237, which will be described later. The humidifying unit 231 humidifies the coarsely crushed pieces M2 contained in the coarsely-crushed-pieces reservoir portion 11. The humidifying unit 231 is a vaporizing humidifying unit that includes a filter 32 containing moisture and produces humidified air WA by letting air pass through the filter 32. Supplying the humidified air WA to the coarsely crushed pieces M2 makes it possible to prevent the electrostatic cling of the coarsely crushed pieces M2 to the inner wall of the coarsely-crushed-pieces reservoir portion 11 and the like. The humidifying unit 231 is not limited to a vaporizing humidifying unit; for example, it may be an ultrasonic humidifying unit. Similarly, the humidifying unit 232, 233, 234, which will be described later, may be an ultrasonic humidifying unit.

The coarsely-crushed-pieces reservoir portion 11 of the coarsely-crushed-pieces supplying unit 10 is connected to the defibrating unit 29 through a coarsely-crushed-pieces sending portion 247 and a pipe 241 that make up the transportation portion 240 to be described later. The coarsely crushed pieces M2 supplied from the coarsely-crushed-pieces reservoir portion 11 are sent to the defibrating unit 29 through the coarsely-crushed-pieces sending portion 247 and the pipe 241.

As illustrated in FIG. 1, the defibrating unit 29 is a section that performs a defibrating process of defibrating the coarsely crushed pieces M2 in air, which means dry defibration. It is possible to produce a defibrated material M3 from the coarsely crushed pieces M2 through the defibrating process performed by the defibrating unit 29. The term "defibration" means the disentanglement of the coarsely crushed pieces M2 made of plural entangled fibers into individual fibers. The result of the disentanglement is the defibrated material M3. The defibrated material M3 has a string shape or a ribbon shape. The defibrated material M3 may be in a state of so-called "lumps", in which defibrated fibers are intertwined with one another in an agglomerated manner.

The defibrating unit 29, by rotating its rotor 293, is capable of producing a flow of air toward the screening unit 14, that is, airflow in the downstream direction. By this means, it is possible to take in the coarsely crushed pieces M2 from the pipe 241 via a coarsely-crushed-pieces inlet 291 that is an upstream-side opening of the defibrating unit 29, and it is possible to let out the defibrated material M3 obtained through the defibration processing via a defibrated material outlet 292 of the defibrating unit 29 and send it to the screening unit 14 through a pipe 242.

The pipe 242 is connected to the downstream-side port of the defibrating unit 29. The blower 261, which is, for example, a turbo-type fan, is provided on a portion located between the ends of the pipe 242. The blower 261 is an airflow generator that generates airflow toward the screening unit 14. This facilitates taking the coarsely crushed pieces M2 into the defibrating unit 29 and sending the defibrated material M3 out to the screening unit 14. As will be described later, although the defibrating unit 29 has a structure for smooth passing of the coarsely crushed pieces M2, a raw material, and for smooth defibration processing, the operation of the blower 261 provided downstream of the defibrating unit 29 facilitates the passing of the coarsely crushed pieces M2 inside the defibrating unit 29 and the defibration processing. The blower 261 may be provided upstream of the defibrating unit 29.

The screening unit 14 is a section that performs a screening process of screening the defibrated material M3 according to the lengths of fibers. In the screening unit 14, the defibrated material M3 is sorted into a first screened material M4-1 and a second screened material M4-2, which has a greater fiber length than the first screened material M4-1. The first screened material M4-1 has a size suitable for the subsequent production of recycled paper S. The second screened material M4-2 contains, for example, insufficiently defibrated fibers, excessive agglomeration of defibrated fibers, and the like.

The screening unit 14 has a drum portion 141 and a housing portion 142, which houses the drum portion 141.

The drum portion 141 is a sieve that has a cylindrical net structure and rotates around its central axis. The defibrated material M3 flows into the drum portion 141. By rotation of the drum portion 141, the defibrated material M3 that is smaller than the mesh of the net is sorted as the first screened material M4-1, and the defibrated material M3 that is larger than the mesh of the net is sorted as the second screened material M4-2.

The first screened material M4-1 falls from the drum portion 141. On the other hand, the second screened material M4-2 is sent to a pipe 243 connected to the drum portion 141. The pipe 243, at its downstream-side end that is the opposite of an end connected to the drum portion 141, is connected to a portion located between the ends of the pipe 241. The second screened material M4-2 that has flowed through the pipe 243 merges with the coarsely crushed pieces M2 inside the pipe 241 and flows together with the coarsely crushed pieces M2 into the defibrating unit 29. By this means, the second screened material M4-2 is returned to the defibrating unit 29 and is subjected to defibration again together with the coarsely crushed pieces M2.

The first screened material M4-1 dropping from the drum portion 141 falls while being dispersed in air, and travels toward the first web forming unit 15, which is located under the drum portion 141. The first web forming unit 15 is a section that performs a first web forming process of forming a first web M5 from the first screened material M4-1. The first web forming unit 15 includes a mesh belt 151, three stretching rollers 152, and a suction unit 153.

The mesh belt 151 is an endless belt, and the first screened material M4-1 accumulates thereon. The mesh belt 151 is stretched around the three stretching rollers 152. The first screened material M4-1 on the mesh belt 151 is transported downstream by the rotation of the stretching rollers 152.

The first screened material M4-1 has a size larger than the mesh of the mesh belt 151. Therefore, the first screened material M4-1 is unable to pass through the mesh belt 151 and is thus able to accumulate on the mesh belt 151. The first screened material M4-1 is transported downstream together with the mesh belt 151 while accumulating on the mesh belt 151. Therefore, the first web M5 that has a layer shape is formed.

There is a possibility that the first screened material M4-1 contains, for example, dust particles or the like. For example, coarse crushing or defibration sometimes produces dust particles or the like. The dust particles or the like are collected into the collection unit 27 to be described later.

The suction unit 153 is a suction mechanism that sucks air from below the mesh belt 151. By this means, it is possible to suck dust particles or the like that have passed through the mesh belt 151, together with air.

The suction unit 153 is connected to the collection unit 27 via a pipe 244. The dust particles or the like sucked by the suction unit 153 are collected into the collection unit 27.

A pipe 245 is connected to the collection unit 27. A blower 262 is provided on a portion located between the ends of the pipe 245. By the operation of the blower 262, a suction force can be generated in the suction unit 153. This facilitates the forming of the first web M5 on the mesh belt 151. The first web M5 formed in this way does not contain dust particles or the like. The dust particles or the like flow through the pipe 244 to reach the collection unit 27 due to the operation of the blower 262.

The housing portion 142 is connected to the humidifying unit 232. The humidifying unit 232 is a vaporizing humidifying unit. Therefore, humidified air is supplied into the housing portion 142. The humidified air humidifies the first screened material M4-1. This prevents the electrostatic cling of the first screened material M4-1 to the inner wall of the housing portion 142.

The humidifying unit 235 is provided downstream of the screening unit 14. The humidifying unit 235 is an ultrasonic humidifying unit that forms a mist. Ultrasonic misting supplies moisture to the first web M5, thereby adjusting the moisture content of the first web M5. The moisture adjustment prevents the electrostatic cling of the first web M5 to the mesh belt 151. Therefore, the first web M5 comes off easily from the mesh belt 151 at a position where the mesh belt 151 is turned back by the stretching roller 152.

The fragmenting unit 16 is provided downstream of the humidifying unit 235. The fragmenting unit 16 is a section that performs a fragmenting process, in which the first web M5 that has come off from the mesh belt 151 is fragmented. The fragmenting unit 16 includes a propeller 161 that is rotatably supported and a housing portion 162 that houses the propeller 161. It is possible to fragment the first web M5 by rotating the propeller 161. The first web M5 is broken into fragments M6. The fragments M6 fall inside the housing portion 162.

The housing portion 162 is connected to the humidifying unit 233. The humidifying unit 233 is a vaporizing humidifying unit. Therefore, humidified air is supplied into the housing portion 162. The humidified air prevents the electrostatic cling of the fragments M6 to the propeller 161 or the inner wall of the housing portion 162.

The mixing unit 17 is provided downstream of the fragmenting unit 16. The mixing unit 17 is a section that performs a mixing process of mixing the fragments M6 with an additive. The mixing unit 17 includes an additive supplying portion 171, a pipe 172, and a blower 173.

The pipe 172 is a flow passage which connects the housing portion 162 of the fragmenting unit 16 and a housing 182 of the dispersing unit 18 and through which a mixture M7 of the fragments M6 and the additive flows.

The additive supplying portion 171 is connected to a portion located between the ends of the pipe 172. The additive supplying portion 171 includes a housing portion 170 that contains an additive and a screw feeder 174 provided inside the housing portion 170. By rotation of the screw feeder 174, the additive contained inside the housing portion 170 is forced out of the housing portion 170 and is then supplied into the pipe 172. The additive supplied into the pipe 172 is mixed with the fragments M6 to turn into the mixture M7.

Examples of the additive supplied from the additive supplying portion 171 are a binder for bonding fibers to one another, a colorant for coloring fibers, an aggregation inhibitor for inhibiting aggregation of fibers, a flame retardant for making fibers and the like difficult to burn, a paper strengthening agent for enhancing the strength of recycled paper S, and a defibrated material. Any one of these kinds of the additive, or a combination of two or more, may be used. In the description below, as an example, a case where the additive is a binder P1 will be explained. Since the additive contains a binder for bonding fibers to one another, it is possible to enhance the strength of recycled paper S.

Examples of the binder P1 are naturally-derived matters such as starch, dextrin, glycogen, amylose, hyaluronic acid, arrowroot, konjac, dogtooth violet starch, etherified starch, esterified starch, natural gum glue, fiber induction glue, seaweed, animal protein, etc., or polyvinyl alcohol, polyacyric acid, polyacrylamide, or the like. Any one selected from among those enumerated here, or a combination of two or more, can be used. A preferred example is a naturally-derived matter. A more preferred example is starch. Moreover, for example, various kinds of thermoplastic resin such as polyolefin, acrylic resin, polyvinyl chloride, polyester, polyamide, various kinds of thermoplastic elastomer, or the like can also be used.

The blower 173 is provided downstream of the additive supplying portion 171 on a portion located between the ends of the pipe 172. The action of the rotating portion such as blades of the blower 173 facilitates the mixing of the fragments M6 and the binder P1. The blower 173 is able to generate airflow toward the dispersing unit 18. The airflow stirs the fragments M6 and the binder P1 inside the pipe 172. Therefore, the mixture M7 is sent to the dispersing unit 18 in a state in which the fragments M6 and the binder P1 are uniformly dispersed. The fragments M6 in the mixture M7 are disentangled in the process of flowing through the pipe 172, thereby turning into a finer fibrous form.

The blower 173 is electrically coupled to a controller 28 for control of its operation. In addition, it is possible to adjust an amount of air sent into a drum 181 by adjusting an amount of air blown by the blower 173.

Though not illustrated, the drum-side 181 end portion of the pipe 172 is bifurcated, and these two bifurcated ends are connected to non-illustrated inlets formed in end faces of the drum 181 respectively.

The dispersing unit 18 illustrated in FIG. 1 is a section that performs a disentangling process of disentangling fibers intertwined with one another in the mixture M7. The dispersing unit 18 includes the drum 181 that takes in and lets out the mixture M7 that is a defibrated material and the housing 182 that houses the drum 181.

The drum 181 is a sieve that has a cylindrical net structure and rotates around its central axis. When the drum 181 rotates, fibers, etc. that are smaller than the mesh of the net, among those contained in the mixture M7, are able to pass through the drum 181. In this process, the mixture M7 becomes disentangled and is then discharged together with air. That is, the drum 181 functions as a discharging portion that discharges a material that contains fibers.

The drum 181 is connected to a non-illustrated driver and rotates due to rotational power outputted from the driver. The driver is electrically coupled to the controller 28 for control of its operation.

The housing 182 is connected to the humidifying unit 234. The humidifying unit 234 is a vaporizing humidifying unit. Therefore, humidified air is supplied into the housing 182. It is possible to humidify the inside of the housing 182 by means of this humidified air, thereby preventing the electrostatic cling of the mixture M7 to the inner wall of the housing 182.

The mixture M7 having been discharged from the drum 181 falls while being dispersed in air and travels toward the second web forming unit 19, which is located under the drum 181. The second web forming unit 19 is a section that performs a second web forming process of forming a second web M8, which is obtained by accumulation of the mixture M7. The second web forming unit 19 includes a mesh belt 191, stretching rollers 192, and a suction unit 193.

The mesh belt 191 is a mesh member. In the illustrated structure, it is an endless belt. The mixture M7 having been dispersed by and discharged from the dispersing unit 18 accumulates on the mesh belt 191. The mesh belt 191 is stretched around the four stretching rollers 192. The mixture M7 on the mesh belt 191 is transported downstream by the rotation of the stretching rollers 192.

Though the mesh belt 191 is used as an example of the mesh member in the illustrated structure, the scope of the present disclosure is not limited thereto; for example, it may have a shape like a flat plate.

The size of most of the mixture M7 on the mesh belt 191 is larger than the mesh of the mesh belt 191. Therefore, most of the mixture M7 is unable to pass through the mesh belt 191 and is thus able to accumulate on the mesh belt 191. The mixture M7 is transported downstream together with the mesh belt 191 while accumulating on the mesh belt 191. Therefore, the second web M8 that has a layer shape is formed.

The suction unit 193 is a suction mechanism that sucks air from below the mesh belt 191. Therefore, it is possible to suck the mixture M7 onto the mesh belt 191, thereby facilitating the accumulation of the mixture M7 on the mesh belt 191.

A pipe 246 is connected to the suction unit 193. A blower 263 is provided on a portion located between the ends of the pipe 246. By the operation of the blower 263, a suction force can be generated in the suction unit 193.

The humidifying unit 236 is provided downstream of the dispersing unit 18. The humidifying unit 236 is an ultrasonic humidifying unit, similarly to the humidifying unit 235. Ultrasonic misting supplies moisture to the second web M8, thereby adjusting the moisture content of the second web M8. The moisture adjustment prevents the electrostatic cling of the second web M8 to the mesh belt 191. Therefore, the second web M8 comes off easily from the mesh belt 191 at a position where the mesh belt 191 is turned back by the stretching roller 192. The humidifying unit 235, 236 may be a vaporizing humidifying unit.

The total amount of moisture added to the humidifying units 231 to 236 may be, for example, preferably, 0.5 parts by mass or more and 20 parts by mass or less with respect to 100 parts by mass of the material before humidification.

The shape forming unit 20 is provided downstream of the second web forming unit 19. The shape forming unit 20 is a section that performs a sheet forming process of forming recycled paper S from the second web M8. The shape forming unit 20 includes a pressing portion 201 and a heating portion 202.

The pressing portion 201 includes a pair of calendar rollers 203 and is able to press the second web M8 between the calendar rollers 203 without heating. This increases the density of the second web M8. When heat is applied, a preferred degree of heating is, for example, a degree that does not cause the melting of the binder P1. The second web M8 with increased density is transported to the heating portion 202. One of the pair of calendar rollers 203 is a drive roller that is driven by the operation of a motor that is not illustrated, and the other is a driven roller.

The heating portion 202 includes a pair of heating rollers 204. It is possible to apply pressure while heating the second web M8 between the heating rollers 204. The heating and pressing causes the melting of the binder P1 in the second web M8. The molten binder P1 bonds the fibers together. By this means, the recycled paper S is formed. The recycled paper S is transported to the cutting unit 21. One of the pair of heating rollers 204 is a drive roller that is driven by the operation of a motor that is not illustrated, and the other is a driven roller.

The cutting unit 21 is provided downstream of the shape forming unit 20. The cutting unit 21 is a section that performs a cutting process of cutting the recycled paper S. The cutting unit 21 includes a first cutter 211 and a second cutter 212.

The first cutter 211 cuts the recycled paper S in a direction that intersects with the transportation direction of the recycled paper S, in particular, a direction that is orthogonal thereto.

The second cutter 212 cuts the recycled paper S in a direction parallel to the transportation direction of the recycled paper S downstream of the first cutter 211. The purpose of this cutting is to remove unnecessary both edge portions of the recycled paper S in the width direction to adjust the width of the recycled paper S.

The recycled paper S having a desired shape and a desired size can be obtained by cutting with the first cutter 211 and the second cutter 212 described above. The recycled paper S is further transported downstream to the stock unit 22 and is stored thereon.

Each unit included in the fibrous body processing apparatus 100 described above is electrically coupled to the controller 28. The operations of these units are controlled by the controller 28.

As illustrated in FIG. 4, the controller 28 includes a control unit 281, a storage unit 282, and a communication unit 283.

The control unit 281 includes at least one processor and runs various programs stored in the storage unit 282. For example, a CPU (Central Processing Unit) can be used as the processor. The control unit 281 has various functions such as functions of controlling components related to sheet production among the components of the fibrous body processing apparatus 100, including but not limited to a function of controlling the driving of the blower 261.

For example, programs regarding sheet production, etc. are stored in the storage unit 282. The communication unit 283 is configured as, for example, an I/O interface, and performs communication with the components of the fibrous body processing apparatus 100. The communication unit 283 has a function of communicating with, for example, a non-illustrated computer or a non-illustrated server via a network.

The controller 28 may be built in the fibrous body processing apparatus 100, or may be provided in an external device such as an external computer. The control unit 281 and the storage unit 282 may be, for example, integrated into a single unit. The control unit 281 may be built in the fibrous body processing apparatus 100, and the storage unit 282 may be provided in an external device such as an external computer. The storage unit 282 may be built in the fibrous body processing apparatus 100, and the control unit 281 may be provided in an external device such as an external computer.

Next, the coarsely-crushed-pieces supplying unit 10 will now be explained.

As illustrated in FIG. 2, the coarsely-crushed-pieces supplying unit 10 includes the coarsely-crushed-pieces reservoir portion 11, the weight measurement portion 12, the fixed amount supplying portion 13, the humidifying unit 231, the humidified air sending portion 237, the transportation portion 240, and a returning passage 5.

The coarsely-crushed-pieces reservoir portion 11 is an example of a first processing unit that performs first processing on the coarsely crushed pieces M2, a raw material. That is, this section stores the coarsely crushed pieces M2 and performs processing for humidifying the coarsely crushed pieces M2 by means of the humidified air WA supplied from the humidifying unit 231.

The coarsely-crushed-pieces reservoir portion 11 includes a reservoir tank 111 that has a coarsely-crushed-pieces feed port 112 and a coarsely-crushed-pieces exit port 110. A cover member 113 for opening and closing the coarsely-crushed-pieces feed port 112 by being rotated is provided on the coarsely-crushed-pieces feed port 112. With the cover member 113 opened, the coarsely crushed pieces M2 are fed into the reservoir tank 111 through the coarsely-crushed-pieces feed port 112. The cover member 113 is closed when humidification processing on the coarsely crushed pieces M2 in the reservoir tank 111 is performed. The cover member 113 may be omitted with connection of a non-illustrated coarsely-crushed-pieces supplying pipe to the coarsely-crushed-pieces feed port 112, and the coarsely crushed pieces M2 may be fed into the reservoir tank 111 through this coarsely-crushed-pieces supplying pipe.

The coarsely crushed pieces M2 having been subjected to the humidification processing inside the reservoir tank 111 are let out of the reservoir tank 111 through the coarsely-crushed-pieces exit port 110. An opening-and-closing unit such as, for example, a shutter for switching the coarsely-crushed-pieces exit port 110 between an open state and a closed state is provided on the coarsely-crushed-pieces exit port 110, though not illustrated. For example, the operation of the opening-and-closing unit is controlled by the controller 28, and the open/closed status of the coarsely-crushed-pieces exit port 110 is switched in accordance with the operation of the opening-and-closing unit. This makes it possible to let out a desired amount of the coarsely crushed pieces M2 from the reservoir tank 111 at a desired timing.

The humidifying unit 231 is a vaporizing humidifier and sends the humidified air WA into the coarsely-crushed-pieces reservoir portion 11 so as to humidify the coarsely crushed pieces M2 contained therein. That is, the humidifying unit 231 generates the humidified air WA and supplies the humidified air WA to the coarsely-crushed-pieces reservoir portion 11. The humidifying unit 231 includes a container 31, a filter 32, and a fan 33.

The container 31 has an air inlet 311, an air outlet 312, and a liquid feed inlet 313. The air inlet 311 is an opening through which air is taken into the container 31 by operating the fan 33 and a fan 314. The air outlet 312 is an opening through which air is let out of the container 31 by operating the fans 33 and 314.

The humidified air sending portion 237 is a first supply passage through which humidified air WA is supplied from the humidifying unit 231 to the coarsely-crushed-pieces reservoir portion 11. The humidified air sending portion 237 is a sending pipe that has an upstream-side end portion 238 and a downstream-side end portion 239. The upstream-side end portion 238 is connected to the air outlet 312. The downstream-side end portion 239 is connected to the reservoir tank 111 of the coarsely-crushed-pieces reservoir portion 11. The humidified air sending portion 237 includes the fan 314 provided on a portion located between the ends of the sending pipe.

The fan 314 generates airflow going from the upstream side toward the downstream side inside the sending pipe of the humidified air sending portion 237. That is, airflow directed toward the coarsely-crushed-pieces reservoir portion 11 is generated. The fan 314 includes rotary blades and a motor that drives and rotates the rotary blades. The motor that is the driver of the fan 314 is electrically coupled to the controller 28 for control of its operation. As illustrated in FIG. 2, due to the operation of the fan 314, the humidified air WA is sent from the upstream side toward the downstream side inside the humidified air sending portion 237.

The operation of the fan 314 may be linked with that of the fan 33, which will be described below, or may be independent of that of the fan 33.

As illustrated in FIG. 2, the liquid feed inlet 313 is a port for taking a humidifying liquid, for example, water, into the container 31. A non-illustrated cover member, a non-illustrated shutter, or the like is provided on the liquid feed inlet 313 to make it openable and closable.

The filter 32 is disposed inside the container 31, configured to be able to suck up water contained in the container 31 to become impregnated therewith, and made of, for example, a woven fabric, a non-woven fabric, or a porous member such as a sponge. The fan 33 includes rotary blades and a motor that drives and rotates the rotary blades. As illustrated in FIG. 4, the motor that is the driver of the fan 33 is electrically coupled to the controller 28 for control of its operation. As illustrated in FIG. 2, by operating the fan 33, it is possible to generate the humidified air WA having increased humidity by causing air to pass through the filter 32 that contains moisture and performing vaporization, and to let it out through the air outlet 312.

The humidified air WA having been generated at the humidifying unit 231 in this way is supplied through the humidified air sending portion 237 to the reservoir tank 111 of the coarsely-crushed-pieces reservoir portion 11. By this means, it is possible to humidify the coarsely crushed pieces M2 contained in the coarsely-crushed-pieces reservoir portion 11 moderately. The humidification makes the coarsely crushed pieces M2 less susceptible to the effect of an electrostatic force. Therefore, advantageously, the entanglement of the coarsely crushed pieces M2 with one another and the electrostatic cling thereof to the inner wall of the coarsely-crushed-pieces reservoir portion 11 and the like are suppressed.

An amount of moisture added to the coarsely crushed pieces M2 through the humidification by the humidifying unit 231 may be, for example, preferably, 0.01 parts by mass or more and 5 parts by mass or less with respect to 100 parts by mass of the coarsely crushed pieces M2 before humidification. This makes it possible to humidify the coarsely crushed pieces M2 without excess or deficiency, thereby producing the above-described electrostatic-cling prevention effect effectively.

The coarsely-crushed-pieces supplying unit 10 includes the transportation portion 240 for sending the coarsely crushed pieces M2 from the coarsely-crushed-pieces reservoir portion 11, which is an example of a first processing unit, to the defibrating unit 29, which is an example of a second processing unit. The coarsely crushed pieces M2 having been humidified at the coarsely-crushed-pieces reservoir portion 11 are sent through the transportation portion 240 to the defibrating unit 29 via the weight measurement portion 12 and the fixed amount supplying portion 13. In this case, the coarsely crushed pieces M2 are sent together with the humidified air WA.

The transportation portion 240 includes a first transportation portion used for the first half of transportation of the coarsely crushed pieces M2 and the humidified air WA, that is, transportation at the upstream side, and a second transportation portion used for the second half of transportation of the coarsely crushed pieces M2 and the humidified air WA, that is, transportation at the downstream side. The first transportation portion is the coarsely-crushed-pieces sending portion 247 disposed for connection from the coarsely-crushed-pieces exit port 110 of the coarsely-crushed-pieces reservoir portion 11 to the fixed amount supplying portion 13. The second transportation portion is configured as the pipe 241 for connecting the downstream-side end portion of the coarsely-crushed-pieces sending portion 247 to the coarsely-crushed-pieces inlet 291 of the defibrating unit 29. Therefore, in the present embodiment, the transportation portion 240 is made up of the coarsely-crushed-pieces sending portion 247 and the pipe 241.

The coarsely-crushed-pieces sending portion 247 includes a transportation passage 249. A feeder 248 capable of sending the coarsely crushed pieces M2 from the upstream side toward the downstream side is provided inside the transportation passage 249. At least a part of the transportation passage 249 is made of a pipe-like member. Specific examples of the feeder 248 include a screw feeder having a structure similar to that of the screw feeder 174 described above, a vibration feeder equipped with a vibration exciter, and a belt transportation mechanism. Any two or more of them may be combined.

However, the structure of the coarsely-crushed-pieces sending portion 247 is not limited to this example. It may have an air-carry structure, a free fall structure, or the like. Alternatively, this structure may be combined with the feeder 248.

The coarsely-crushed-pieces sending portion 247 and the pipe 241 constitute a second supply passage through which the coarsely crushed pieces M2 and the humidified air WA are supplied from the coarsely-crushed-pieces reservoir portion 11 to the defibrating unit 29.

At least a part of the second supply passage doubles as the transportation portion 240. In the present embodiment, a whole of the coarsely-crushed-pieces sending portion 247 and the pipe 241 that constitute the second supply passage doubles as the transportation portion 240.

However, in the present disclosure, without being limited to this structure, a part of the second supply passage may double as the transportation portion 240, and another part of the second supply passage may be configured as a passage different from the transportation portion 240, for example, a passage that bypasses the weight measurement portion 12 and the fixed amount supplying portion 13 and connects the coarsely-crushed-pieces reservoir portion 11 to a portion located between the ends of the pipe 241.

When the coarsely crushed pieces M2 are let out of the reservoir tank 111 through the coarsely-crushed-pieces exit port 110, they go out together with the humidified air WA contained in the reservoir tank 111. Therefore, the coarsely crushed pieces M2 and the humidified air WA are sent downstream through the coarsely-crushed-pieces sending portion 247.

The weight measurement portion 12 is provided downstream of the coarsely-crushed-pieces reservoir portion 11 via the coarsely-crushed-pieces sending portion 247.

As illustrated in FIG. 3, the weight measurement portion 12 includes an open-topped cylindrical container 121, which is a catcher for receiving the coarsely crushed pieces M2, and a load cell 122, which is provided on the bottom of the container 121 and serves as a weight measuring unit. The container 121 temporarily contains the coarsely crushed pieces M2 that are being sent near the downstream-side end portion of the coarsely-crushed-pieces sending portion 247. The container 121 is not limited to the above-mentioned open-topped cylinder-like container. It may have a box-like shape. In this case, the shape of its bottom portion in a plan view is not specifically limited and may have any shape such as a circular shape, an elliptical shape, a polygonal shape, or the like.

The load cell 122 has a function of detecting an external force and converting the result of detection into an electric signal and outputting it. Moreover, the load cell 122 is provided in such a way as to support the container 121 from below. Therefore, it is possible to detect the weight of the coarsely crushed pieces M2 contained in the container 121.

Moreover, as illustrated in FIG. 4, the load cell 122 is electrically coupled to the controller 28, a detection signal outputted from the load cell 122 is transmitted to the controller 28, and a detection result about the weight of the coarsely crushed pieces M2 can be obtained. The scheme of the load cell 122 is not specifically limited. It may be a magnetostrictive-type load cell, a capacitance-type load cell, a gyro-type load cell, a strain-gauge-type load cell, or the like.

As illustrated in FIG. 3, the fixed amount supplying portion 13 is provided downstream of the weight measurement portion 12. The fixed amount supplying portion 13 has a shutter 131 for opening and closing an opening 120 provided in the bottom of the container 121. The shutter 131 has a non-illustrated driver such as, for example, a solenoid. As illustrated in FIG. 4, the driver of the shutter 131 is electrically coupled to the controller 28 for control of its operation. That is, the opening and closing of the shutter 131 is controlled by the controller 28.

When the shutter 131 is in a closed state, the coarsely crushed pieces M2 having been sent from the coarsely-crushed-pieces sending portion 247 accumulate gradually in the container 121. When the weight of the coarsely crushed pieces M2 detected by the load cell 122 reaches a predetermined value, the shutter 131 becomes open, and a predetermined amount of the coarsely crushed pieces M2 goes out via the opening 120 and falls to be supplied to the defibrating unit 29 through the pipe 241 provided downstream thereof. Then, the shutter 131 is put back into a closed position again, thereby causing gradual accumulation of the coarsely crushed pieces M2 in the container 121. By repeating these operations, it is possible to supply a fixed amount of the coarsely crushed pieces M2 to the defibrating unit 29.

The structure of the fixed amount supplying portion 13 is not limited to the above example. It may include a rotation driver that causes the container 121 to rotate. In this case, when the weight of the coarsely crushed pieces M2 detected by the load cell 122 reaches a predetermined value, the container 121 is turned upside down. By this means, it is possible to let the coarsely crushed pieces M2 having accumulated in the container 121 fall to be supplied to the defibrating unit 29. The upstream-side end portion of the pipe 241 is connected to the fixed amount supplying portion 13. The downstream-side end portion of the pipe 241 is connected to the coarsely-crushed-pieces inlet 291 of the defibrating unit 29.

The defibrating unit 29 is an example of a second processing unit that performs second processing on the coarsely crushed pieces M2. That is, the defibrating unit 29 is a section that performs defibration processing to defibrate the coarsely crushed pieces M2.

For example, a turbo mill can be used as the defibrating unit 29. The turbo mill includes a cylindrical casing 290 that has the coarsely-crushed-pieces inlet 291 and the defibrated material outlet 292, a liner 294 provided on the inner circumferential surface of the casing 290, a rotor 293 that rotates inside the casing 290 without being in contact with the liner 294, and a non-illustrated motor that is a driver for rotation of the rotor 293. The liner 294 has non-illustrated teeth in the circumferential direction. The rotor 293 has a plurality of non-illustrated blades arranged radially.

The motor provided in the defibrating unit 29 and configured to drive and rotate the rotor 293 is electrically coupled to the controller 28 for control of its operation. The rotor 293 is rotated/stopped in response to energization ON/OFF to the motor, thereby performing/stopping defibration processing.

In a state in which the defibrating unit 29 is activated to perform defibration processing, the coarsely crushed pieces M2 having been fed into the casing 290 via the coarsely-crushed-pieces inlet 291 are pulverized and defibrated when passing through a clearance 295 between the rotor 293 that is rotating and the liner 294, and the defibrated material M3 obtained as a result of this processing is outputted from the defibrated material outlet 292.

Next, a flow of the humidified air WA generated at the humidifying unit 231 will now be described.

The humidified air WA generated at the humidifying unit 231 is supplied into the coarsely-crushed-pieces reservoir portion 11 via the humidified air sending portion 237. The humidified air WA contained in the coarsely-crushed-pieces reservoir portion 11, together with the coarsely crushed pieces M2, is supplied to the defibrating unit 29 via the coarsely-crushed-pieces exit port 110, the coarsely-crushed-pieces sending portion 247, and the pipe 241. That is, the humidifying unit 231 has both a function of humidifying the coarsely-crushed-pieces reservoir portion 11 and a function of humidifying the defibrating unit 29 and supplies the humidified air WA to the coarsely-crushed-pieces reservoir portion 11 and the defibrating unit 29 sequentially. At the defibrating unit 29, the entry of the humidified air WA makes it possible to better defibrate the coarsely crushed pieces M2, resulting an improvement in the quality of the defibrated material M3 that is obtained.

The fibrous body processing apparatus 100 includes a returning passage 5 for returning the humidified air WA that is present inside the pipe 241 or inside the defibrating unit 29 to the humidifying unit 231. In the present embodiment, the returning passage 5 is an air-sending pipe 50 that has an upstream-side end portion 51 and a downstream-side end portion 52. The upstream-side end portion 51 of the returning passage 5 is connected directly or indirectly to the second supply passage, more specifically, to a portion located between the ends of the pipe 241 included in the transportation portion 240. The downstream-side end portion 52 of the returning passage 5 is connected to the container 31 of the humidifying unit 231.

Even while the production of the recycled paper S by the fibrous body processing apparatus 100 is paused, there are cases where it is desired to humidify the coarsely crushed pieces M2 contained in the coarsely-crushed-pieces reservoir portion 11. Suppose that, in such a case, the operation of the defibrating unit 29 is stopped, and the humidifying unit 231 is operating. Stopping the operation of the defibrating unit 29 makes it difficult to supply the humidified air WA to the defibrating unit 29. However, since the returning passage 5 is provided, a circulation passage for the humidified air WA, by way of which the humidified air WA generated at the humidifying unit 231 flows through the humidified air sending portion 237, the coarsely-crushed-pieces reservoir portion 11, the coarsely-crushed-pieces sending portion 247, the pipe 241, and the returning passage 5 sequentially to return to the humidifying unit 231, is formed. Since the circulation passage for the humidified air WA is formed as described above, even when the operation of the defibrating unit 29 is stopped, it is possible to supply the humidified air WA to the coarsely-crushed-pieces reservoir portion 11 and to keep the coarsely crushed pieces M2 contained in the coarsely-crushed-pieces reservoir portion 11 in a humidified state. Consequently, when the fibrous body processing apparatus 100 that has been paused is restarted, it is possible to supply the coarsely crushed pieces M2 that are humidified enough to the defibrating unit 29, even immediately after the restart. Therefore, it is possible to enhance the quality of the recycled paper S that is produced.

As described above, the fibrous body processing apparatus 100 includes: the humidifying unit 231 that generates humidified air WA; the coarsely-crushed-pieces reservoir portion 11 that is an example of a first processing unit that performs processing, humidification processing in the present embodiment, on coarsely crushed pieces M2 as an example of a material that contains fibers; the defibrating unit 29 that is an example of a second processing unit that performs processing, defibration processing in the present embodiment, on the coarsely crushed pieces M2 that were humidified at the coarsely-crushed-pieces reservoir portion 11; the humidified air sending portion 237 that is an example of a first supply passage through which humidified air WA is supplied from the humidifying unit 231 to the coarsely-crushed-pieces reservoir portion 11; the transportation portion 240 that is an example of a second supply passage through which humidified air WA is supplied from the coarsely-crushed-pieces reservoir portion 11 to the defibrating unit 29, together with the coarsely crushed pieces M2; and the returning passage 5 which includes the upstream-side end portion 51 and the downstream-side end portion 52 and through which humidified air WA is returned from the transportation portion 240 or the defibrating unit 29 to the humidifying unit 231. With this structure, it is possible to supply the humidified air WA to the first processing unit even while the operation of the second processing unit is paused, not to mention while the second processing unit is operating. That is, it is possible to supply the humidified air WA to the coarsely-crushed-pieces reservoir portion 11 even while the operation of the defibrating unit 29 is paused, not to mention while the defibrating unit 29 is operating.

The first processing unit stores the coarsely crushed pieces M2 as an example of the material and performs processing for humidifying the coarsely crushed pieces M2, and the second processing unit performs processing for defibrating the coarsely crushed pieces M2 that were humidified. Supplying the humidified air WA to the coarsely-crushed-pieces reservoir portion 11 while the operation of the defibrating unit 29 is paused has a significant influence on the immediately-after-the-restart quality of the recycled paper S when the fibrous body processing apparatus 100 whose operation has been temporarily paused is restarted. Therefore, it is possible to make the quality of the recycled paper S immediately after restarting the fibrous body processing apparatus 100 high by applying the coarsely-crushed-pieces reservoir portion 11 to the first processing unit and by applying the defibrating unit 29 to the second processing unit.

The scope of the present disclosure is not limited to the structure described above. The disclosed concept may be applied to the humidifying units 232 to 236 disposed at various positions in the fibrous body processing apparatus 100 and to the first and second processing units disposed in the neighborhood thereof. That is, a humidifying unit that includes the returning passage 5 according to each embodiment of the present disclosure may be applied to the humidifying unit 232. In this case, the first processing unit corresponds to the screening unit 14, and the second processing unit corresponds to the first web forming unit 15.

Alternatively, a humidifying unit that includes the returning passage 5 according to each embodiment of the present disclosure may be applied to the humidifying unit 233. In this case, the first processing unit corresponds to the fragmenting unit 16, and the second processing unit corresponds to the mixing unit 17.

Alternatively, a humidifying unit that includes the returning passage 5 according to each embodiment of the present disclosure may be applied to the humidifying unit 234. In this case, the first processing unit corresponds to the dispersing unit 18, and the second processing unit corresponds to the second web forming unit 19.

The upstream-side end portion 51 of the returning passage 5 is connected directly or indirectly to the second supply passage, more specifically, to the pipe 241 of the transportation portion 240. This structure makes it possible to install the returning passage 5 on an existing model with a simpler upgrading work, as compared with a structure in which the upstream-side end portion 51 is directly connected to the defibrating unit 29.

As described earlier, the humidifying unit 231 is a vaporizing humidifying unit. A vaporizing humidifying unit is advantageous over humidifying units of other types, for example, over an ultrasonic humidifying unit, in that the former has a simpler structure and is easily available; on the other hand, however, it takes longer for the former to restart the generation of humidified air WA after a pause in humidification. Therefore, it is more useful to apply a vaporization-type humidifying unit 231 to the present disclosure when the operation of the defibrating unit 29 is paused and then restarted while continuing the operation of the humidifying unit 231.

As described earlier, the fibrous body processing apparatus 100 includes the transportation portion 240 through which the coarsely crushed pieces M2 as an example of the material are sent from the coarsely-crushed-pieces reservoir portion 11, which is an example of the first processing unit, to the defibrating unit 29, which is an example of the second processing unit, wherein at least a part of the coarsely-crushed-pieces sending portion 247 and the pipe 241 that constitute the second supply passage doubles as the transportation portion 240. This simplifies the structure of piping and makes it possible to supply the coarsely crushed pieces M2 as an example of the material, and the humidified air WA, to the second processing unit smoothly and properly.

The fibrous body processing apparatus 100 includes a switching unit 500 that switches a humidified-air sending status in the returning passage 5 in accordance with an operation status of the defibrating unit 29. The phrase "in accordance with an operation status of the defibrating unit" here means "depending on whether the defibrating unit 29 is in an operating state (in an activated state) or in a non-operating state (in a paused state)".

In the present embodiment, the switching unit 500 puts the returning passage 5 into an air-sending-stopped state, that is, a state in which the humidified air WA is not flowing, when the defibrating unit 29 is in an operating state, and puts the returning passage 5 into an air-sending state, that is, a state in which the humidified air WA is flowing downstream, when the defibrating unit 29 is in a non-operating state.

The switching unit 500 includes, as an example of a blowing unit, a fan 53 that is provided between the upstream-side end portion 51 and the downstream-side end portion 52 of the returning passage 5 and generates airflow going from the upstream side toward the downstream side inside the air-sending pipe 50 of the returning passage 5. That is, the humidified air WA is sent toward the humidifying unit 231 by the operation of the fan 53.

The fan 53 includes rotary blades and a motor that drives and rotates the rotary blades. As illustrated in FIG. 4, the motor that is the driver of the fan 53 is electrically coupled to the controller 28 for control of its operation.

The operation of the fan 53 is linked with that of either the fan 33 described earlier or the fan 314 described earlier, or both; however, the fan 53 may be driven independently of the fan 33 or the fan 314.

The controller 28 controls the operation of the fan 53 in such a way as to put the returning passage 5 into an air-sending-stopped state when the defibrating unit 29 is in an operating state and to put the returning passage 5 into an air-sending state when the defibrating unit 29 is in a non-operating state. Performing this control makes it possible to keep good supply without hindering the supply of the humidified air WA to the defibrating unit 29 through the transportation portion 240 by putting the returning passage 5 into an air-sending-stopped state when the defibrating unit 29 is in an operating state and to facilitate the supply of the humidified air WA to the coarsely-crushed-pieces reservoir portion 11 via the humidifying unit 231 and the humidified air sending portion 237 by putting the returning passage 5 into an air-sending state when the defibrating unit 29 is in a non-operating state. That is, it is possible to facilitate the supply of the humidified air WA to the coarsely-crushed-pieces reservoir portion 11 by performing the returning of the humidified air WA to the humidifying unit 231 through the returning passage 5 only when needed.

As described above, the fibrous body processing apparatus 100 includes the switching unit 500 that switches a humidified-air sending status in the returning passage 5 in accordance with an operation status of the defibrating unit 29 that is an example of the second processing unit; and the control unit 281 that controls the operation of the switching unit 500. This makes it possible to perform the returning of the humidified air WA through the returning passage 5 more reliably even while the operation of the defibrating unit 29 is paused; therefore, regardless of the operation status of the defibrating unit 29, it is possible to supply the humidified air WA to the coarsely-crushed-pieces reservoir portion 11 easily and properly.

The switching unit 500 includes, as an example of a blowing unit, the fan 53 that is provided between the upstream-side end portion 51 and the downstream-side end portion 52 of the returning passage 5 and sends air toward the humidifying unit 231, wherein the control unit 281 controls the operation of the fan 53 in such a way as to put the returning passage 5 into an air-sending-stopped state when the defibrating unit 29, which is an example of the second processing unit, is in an operating state and to put the returning passage 5 into an air-sending state when the defibrating unit 29 is in a non-operating state. This makes it possible to perform the returning of the humidified air WA through the returning passage 5 more reliably even while the operation of the defibrating unit 29 is paused; therefore, it is possible to supply the humidified air WA to the coarsely-crushed-pieces reservoir portion 11 more reliably by using a simple method of controlling the operation of the fan 53.

The scope of the present disclosure is not limited to the structure described above. The control unit 281 may be configured to allow the user to select whether or not to operate the fan 53 when the defibrating unit 29 is in a non-operating state. The control unit 281 may perform control such that the fan 53 is always operated regardless of the operation status of the defibrating unit 29. In this case, for example, by controlling an amount of energization to the motor configured to drive the fan 53, a setting can be configured in such a way as to make the output of the fan 53, that is, a blowing amount, larger when the defibrating unit 29 is in a non-operating state than when in an operating state.

Though not illustrated, the fibrous body processing apparatus 100 may include, upstream of the coarsely-crushed-pieces supplying unit 10, a raw material supplying unit that supplies a sheet-shaped raw material, and a coarse crusher such as a so-called shredder that coarsely crushes the sheet-shaped raw material. In this case, coarsely crushed pieces M2 are generated at the coarse crusher, and the coarsely crushed pieces M2 are fed into the reservoir tank 111 through the coarsely-crushed-pieces feed port 112.

Second Embodiment

Figure 5:
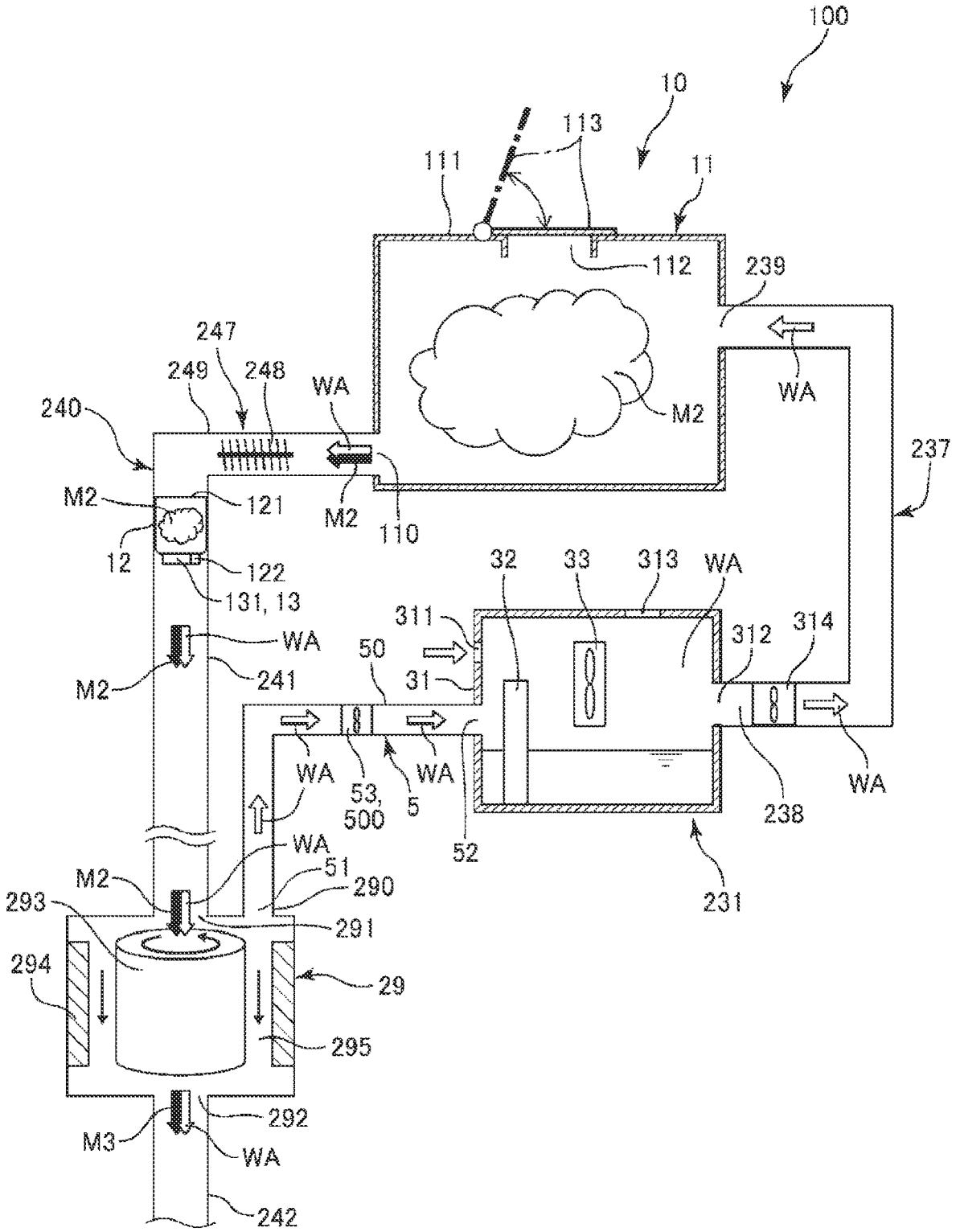
FIG. 5 is a diagram that schematically illustrates the structure of a fibrous body processing apparatus according to a second embodiment, and more particularly, the structure of a coarsely-crushed-pieces supplying unit and the neighborhood thereof.

FIG. 5 is a diagram that schematically illustrates the structure of a fibrous body processing apparatus according to a second embodiment, and more particularly, the structure of a coarsely-crushed-pieces supplying unit and the neighborhood thereof.

With reference to FIG. 5, a fibrous body processing apparatus according to a second embodiment of the present disclosure will now be described. The description below will be focused on the point of difference from the foregoing first embodiment, and the same description will not be repeated.

As illustrated in FIG. 5, the upstream-side end portion 51 of the returning passage 5 is connected to the defibrating unit 29. More particularly, the upstream-side end portion 51 is connected to the coarsely-crushed-pieces inlet 291 of the casing 290. With this structure, it is possible to effectively collect the humidified air WA having been supplied into the defibrating unit 29. Therefore, it is possible to prevent or suppress an excessive amount of moisture inside the defibrating unit 29 or mold growth or rusting inside the defibrating unit 29 due to the moisture.

Third Embodiment

Figure 6:
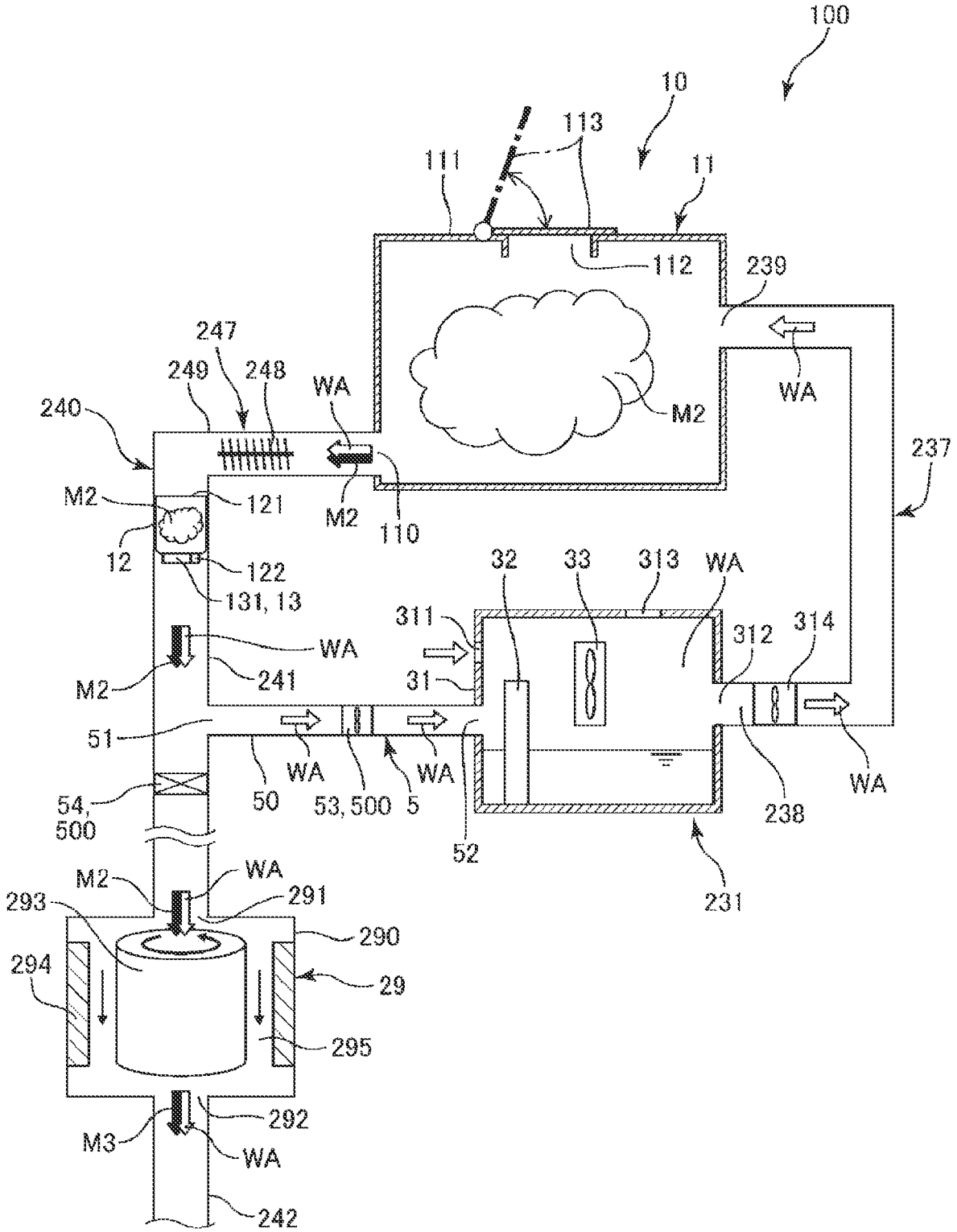
FIG. 6 is a diagram that schematically illustrates the structure of a fibrous body processing apparatus according to a third embodiment, and more particularly, the structure of a coarsely-crushed-pieces supplying unit and the neighborhood thereof.

FIG. 6 is a diagram that schematically illustrates the structure of a fibrous body processing apparatus according to a third embodiment, and more particularly, the structure of a coarsely-crushed-pieces supplying unit and the neighborhood thereof.

With reference to FIGS. 4 and 6, a fibrous body processing apparatus according to a third embodiment of the present disclosure will now be described. The description below will be focused on the point of difference from the foregoing first embodiment, and the same description will not be repeated.

As illustrated in FIG. 6, the switching unit 500 includes a valve 54 that is an example of an opening-and-closing unit configured to switch the transportation portion 240 serving as the second supply passage between an open state and a closed state. The pipe 241 included in the transportation portion 240 has a portion to which the upstream-side end portion 51 is connected directly or indirectly, and the valve 54 is provided downstream of this portion, namely, on the side closer to the defibrating unit 29, and has a function of switching the flow passage of the pipe 241 between an open state and a closed state.

The valve 54 is an electromagnetic valve. That is, the valve 54 incudes a driver such as a solenoid that is not illustrated. As indicated by a dot-and-dash line in FIG. 4, the driver of the valve 54 is electrically coupled to the controller 28 for control of its operation. That is, the opening and closing of the valve 54 is controlled by the controller 28.

The flow passage of the pipe 241 is communicable when the valve 54 is in an open state, and, when in this state, the coarsely crushed pieces M2 and the humidified air WA are supplied to the defibrating unit 29 through the transportation portion 240. The flow passage of the pipe 241 is closed when the valve 54 is in a closed state, and, when in this state, the supply of the coarsely crushed pieces M2 and the humidified air WA to the defibrating unit 29 is shut off.

The controller 28 controls the operation of the valve 54 in such a way as to put the valve 54 into an open state to open the flow passage of the pipe 241 included in the second supply passage when the defibrating unit 29 is in an operating state and to put the valve 54 into a closed state to close the flow passage of the pipe 241 included in the second supply passage when the defibrating unit 29 is in a non-operating state.

By performing this control, it is possible to facilitate the supply of the humidified air WA to the defibrating unit 29 when the defibrating unit 29 is in an operating state and, it is possible to prohibit the supply of the humidified air WA to the defibrating unit 29 and facilitate the sending of the humidified air WA through the returning passage 5 when the defibrating unit 29 is in a non-operating state. That is, it is possible to facilitate the supply of the humidified air WA to the coarsely-crushed-pieces reservoir portion 11 by performing the returning of the humidified air WA to the humidifying unit 231 through the returning passage 5 only when needed.

As described above, the switching unit 500 includes, as an example of an opening-and-closing unit, the valve 54 that switches the pipe 241 of the transportation portion 240 between an open state and a closed state, the valve 54 being provided on the side closer to the defibrating unit 29, which is an example of the second processing unit, than, of the pipe 241 of the transportation portion 240 included in the second supply passage, the portion to which the upstream-side end portion 51 is connected directly or indirectly is, and the control unit 281 controls the operation of the valve 54 in such a way as to cause the valve 54 to open the flow passage of the pipe 241 when the defibrating unit 29 is in an operating state and to cause the valve 54 to close the flow passage of the pipe 241 when the defibrating unit 29 is in a non-operating state. With this structure, even while the operation of the defibrating unit 29 is paused, it is possible to supply the humidified air WA to the coarsely-crushed-pieces reservoir portion 11 more reliably by using a simple method of controlling the operation of the valve 54.

Moreover, the controller 28 controls the operation of the valve 54 and the fan 53 such that the closed state of the valve 54 is synchronized with the air-sending state of the fan 53 and such that the open state of the valve 54 is synchronized with the air-sending-stopped state of the fan 53.

That is, the control unit 281 controls the operation of the fan 53 in such a way as to put the returning passage 5 into the air-sending-stopped state and controls the operation of the valve 54 in such a way as to cause the valve 54 to open the flow passage of the pipe 241 when the defibrating unit 29 is in the operating state, and controls the operation of the fan 53 in such a way as to put the returning passage 5 into the air-sending state and controls the operation of the valve 54 in such a way as to cause the valve 54 to close the flow passage of the pipe 241 when the defibrating unit 29 is in the non-operating state. Thanks to synergy between the effect produced by controlling the fan 53 as described above and the effect produced by controlling the valve 54 as described above, this control makes it possible to supply the humidified air WA to the coarsely-crushed-pieces reservoir portion 11 more reliably even while the operation of the defibrating unit 29 is paused.

As described above, the switching unit 500 includes, as an example of a blowing unit, the fan 53 that is provided between the upstream-side end portion 51 and the downstream-side end portion 52 of the returning passage 5 and sends air toward the humidifying unit 231, and, as an example of an opening-and-closing unit, the valve 54 that switches the coarsely-crushed-pieces sending portion 247 between an open state and a closed state, wherein the pipe 241 included in the second supply passage has a portion to which the upstream-side end portion 51 is connected directly or indirectly, the valve 54 being provided on the side closer to the defibrating unit 29, which is an example of the second processing unit, than this portion is. In addition, the control unit 281 controls the operation of the fan 53 in such a way as to put the returning passage 5 into the air-sending-stopped state and controls the operation of the valve 54 in such a way as to cause the valve 54 to open the flow passage of the pipe 241 when the defibrating unit 29 is in the operating state, and controls the operation of the fan 53 in such a way as to put the returning passage 5 into the air-sending state and controls the operation of the valve 54 in such a way as to cause the valve 54 to close the flow passage of the pipe 241 when the defibrating unit 29 is in the non-operating state. Thanks to synergy between the effect produced by controlling the fan 53 as described above and the effect produced by controlling the valve 54 as described above, this control makes it possible to supply the humidified air WA to the coarsely-crushed-pieces reservoir portion 11 more reliably even while the operation of the defibrating unit 29 is paused.

The controller 28 may control the operation of the valve 54 and the fan 53 such that the timing of the closed state of the valve 54 and the timing of the air-sending state of the fan 53 are different from each other and such that the timing of the open state of the valve 54 and the timing of the air-sending-stopped state of the fan 53 are different from each other.

Although a fibrous body processing apparatus according to the illustrated embodiments has been described above, the scope of the present disclosure is not limited to the foregoing examples. The components constituting the fibrous body processing apparatus may be replaced with any alternatives that fulfill the same functions. Any additional component may be included in the fibrous body processing apparatus. A fibrous body processing apparatus according to the present disclosure may have a combination of the features of the foregoing embodiments.

For example, a structure according to an embodiment that is a combination of the first embodiment and the second embodiment includes a first returning passage for connection between the second supply passage and the humidifying unit 231 and a second returning passage for connection between the defibrating unit 29, which is an example of the second processing unit, and the humidifying unit 231. In this case, the following structure can be adopted: a structure in which the humidified air WA is returned to the humidifying unit 231 by using both the first returning passage and the second returning passage; a structure in which a switching unit for switching between the first returning passage and the second returning passage is provided, either one of the first returning passage and the second returning passage is selected, and the humidified air WA is returned to the humidifying unit 231 by using the selected returning passage; or a structure in which an opening-and-closing unit is provided on each of the first returning passage and the second returning passage, and an open/closed state of each of the opening-and-closing units is selected, thereby returning the humidified air WA to the humidifying unit 231 by using at least one of the first returning passage or the second returning passage, or the like. A fibrous body processing apparatus having such a structure is advantageous in that it is possible to easily adjust, with high precision, a total amount of flow of the humidified air WA through the returning passage, that is, an amount of the humidified air WA supplied back to the coarsely-crushed-pieces reservoir portion 11, which is an example of the first processing unit.

What is claimed is:

1. A fibrous body processing apparatus comprising:

a humidifying unit that generates humidified air;

a first processing unit that processes a material that contains fibers;

a second processing unit that processes the material that has been processed at the first processing unit, the second processing unit including a casing with a wall in which an inlet is formed such that the material enters into the casing through the wall;

a first supply passage through which humidified air is supplied from the humidifying unit to the first processing unit;

a second supply passage through which humidified air is supplied from the first processing unit to the second processing unit, together with the material; and a returning passage which is an air-sending pipe through which humidified air is returned from the second supply passage or the second processing unit to the humidifying unit, the air-sending pipe including a downstream-side end portion and an upstream-side end portion, the downstream-side end portion being connected the humidifying unit, the upstream-side end portion being connected to the wall of the casing of the second processing unit so as to be adjacent to the inlet, or directly or indirectly connected to the second supply passage.

2. The fibrous body processing apparatus according to claim 1, wherein the upstream-side end portion of the air-sending pipe is connected directly or indirectly to the second supply passage.

3. The fibrous body processing apparatus according to claim 1, wherein the humidifying unit is a vaporizing humidifying unit.

4. The fibrous body processing apparatus according to claim 1, further comprising:

a transportation portion through which the material is sent from the first processing unit to the second processing unit, wherein at least a part of the second supply passage doubles as the transportation portion.

5. The fibrous body processing apparatus according to claim 1, wherein the first processing unit stores the material and performs processing for humidifying the material, and the second processing unit performs processing for defibrating the humidified material.

6. The fibrous body processing apparatus according to claim 1, further comprising:

a switching unit that switches a humidified-air sending status in the returning passage in accordance with an operation status of the second processing unit; and a control unit that controls operation of the switching unit.

7. The fibrous body processing apparatus according to claim 6, wherein the switching unit includes a blowing unit that is provided between the upstream-side end portion and the downstream-side end portion of the air-sending pipe and sends air toward the humidifying unit, wherein the control unit controls operation of the blowing unit in such a way as to put the returning passage into an air-sending-stopped state when the second processing unit is in an operating state and to put the returning passage into an air-sending state when the second processing unit is in a non-operating state.

8. The fibrous body processing apparatus according to claim 6, wherein the switching unit includes an opening-and-closing unit that switches the second supply passage between an open state and a closed state, the opening-and-closing unit being provided on a side closer to the second processing unit than, of the second supply passage, a portion to which the upstream-side end portion is connected directly or indirectly is, and the control unit controls operation of the opening-and-closing unit in such a way as to cause the opening-and-closing unit to open the second supply passage when the second processing unit is in an operating state and to cause the opening-and-closing unit to close the second supply passage when the second processing unit is in a non-operating state.

9. The fibrous body processing apparatus according to claim 6, wherein the switching unit includes a blowing unit that is provided between the upstream-side end portion and the downstream-side end portion of the air-sending pipe and sends air toward the humidifying unit, and an opening-and-closing unit that switches the second supply passage between an open state and a closed state, the opening-and-closing unit being provided on a side closer to the second processing unit than, of the second supply passage, a portion to which the upstream-side end portion is connected directly or indirectly is, wherein the control unit controls operation of the blowing unit in such a way as to put the returning passage into an air-sending-stopped state and controls operation of the opening-and-closing unit in such a way as to cause the opening-and-closing unit to open the second supply passage when the second processing unit is in an operating state, and controls the operation of the blowing unit in such a way as to put the returning passage into an air-sending state and controls the operation of the opening-and-closing unit in such a way as to cause the opening-and-closing unit to close the second supply passage when the second processing unit is in a non-operating state.

10. The fibrous body processing apparatus according to claim 1, further comprising:

a switching unit that switches a humidified-air sending status in the returning passage in accordance with an operation status of the second processing unit, the switching unit including a blowing unit that is disposed inside the air-sending pipe and sends the humidified air toward the humidifying unit.

11. The fibrous body processing apparatus according to claim 1, wherein the upstream-side end portion of the air-sending pipe is connected directly to the second supply passage.

12. The fibrous body processing apparatus according to claim 1, wherein the upstream-side end portion of the air-sending pipe is connected to the wall of the casing of the second processing unit so as to be adjacent to the inlet.

* * * * *